US012679681B2

(12) United States Patent
Ishido

(10) Patent No.: US 12,679,681 B2
(45) Date of Patent: Jul. 14, 2026

(54) SHEET CONVEYING DEVICE, IMAGE FORMING APPARATUS, AND OPERATION CONTROL METHOD CAPABLE OF SUPPRESSING OCCURRENCE OF PROBLEMS RELATING TO PAIR OF CONVEYING MEMBERS USED FOR SHEET POSITION CORRECTION

(71) Applicant: KYOCERA Document Solutions Inc., Osaka (JP)

(72) Inventor: Kohei Ishido, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 19 days.

(21) Appl. No.: 18/753,099

(22) Filed: Jun. 25, 2024

(65) Prior Publication Data

US 2025/0011116 A1 Jan. 9, 2025

(30) Foreign Application Priority Data

Jul. 7, 2023 (JP) ..... 2023-111856

(51) Int. Cl.
*B65H 7/02* (2006.01)
*B65H 5/06* (2006.01)

(52) U.S. Cl.
CPC ..... *B65H 7/02* (2013.01); *B65H 5/062* (2013.01); *B65H 2701/1131* (2013.01)

(58) Field of Classification Search
CPC .. B65H 7/02; B65H 5/062; B65H 2701/1131; B65H 3/44; B65H 2404/14; B65H 2513/50; B65H 9/002; B65H 9/20; B65H 7/14; B65H 29/246; B65H 29/52; B65H 2301/42124; B65H 9/106; B65H 2404/144; B65H 2404/172
USPC ..... 271/8.1
See application file for complete search history.

(56) References Cited

U.S. PATENT DOCUMENTS

| | | | | |
|---|---|---|---|---|
| 9,561,922 | B2 * | 2/2017 | Hiratsuka | B65H 3/18 |
| 9,802,775 | B2 * | 10/2017 | Hashimoto | B65H 3/126 |
| 10,358,309 | B2 * | 7/2019 | Yamane | G03G 15/6567 |
| 11,148,892 | B2 * | 10/2021 | Egawa | B65H 7/06 |
| 11,445,082 | B2 * | 9/2022 | Arai | G03G 15/6555 |
| 2016/0159598 | A1 * | 6/2016 | Yamane | G03G 15/6561 271/227 |
| 2018/0194581 | A1 * | 7/2018 | Matsumoto | B65H 7/10 |

(Continued)

FOREIGN PATENT DOCUMENTS

JP 2020142902 A 9/2020

*Primary Examiner* — Sameh Tawfik
(74) *Attorney, Agent, or Firm* — Alleman Hall LLP

(57) ABSTRACT

A sheet conveying device includes a sensor, a movement control portion, a detection processing portion, and a switching processing portion. The sensor detects a position in a width direction of a sheet conveyed by a pair of conveying members. The movement control portion controls the movement along the width direction of the pair of conveying members which is nipping the sheet, based on an amount of shift between the position detected by the sensor and a reference position. The detection processing portion detects a sheet size of the sheet. The switching processing portion switches between permitting and not permitting the movement of the pair of conveying members based on a sheet size associated with a sheet feed source and the sheet size detected by the detection processing portion.

6 Claims, 5 Drawing Sheets

(56) References Cited

U.S. PATENT DOCUMENTS

2022/0267110 A1* 8/2022 Morita ..... B65H 9/103
2022/0324670 A1* 10/2022 Yamamoto ..... G03G 15/6502

* cited by examiner

SHEET CONVEYING DEVICE, IMAGE FORMING APPARATUS, AND OPERATION CONTROL METHOD CAPABLE OF SUPPRESSING OCCURRENCE OF PROBLEMS RELATING TO PAIR OF CONVEYING MEMBERS USED FOR SHEET POSITION CORRECTION

INCORPORATION BY REFERENCE

This application is based upon and claims the benefit of priority from the corresponding Japanese Patent Application No. 2023-111856 filed on Jul. 7, 2023, the entire contents of which are incorporated herein by reference.

BACKGROUND

The present disclosure relates to a sheet conveying device, an image forming apparatus, and an operation control method.

In an image forming apparatus such as a printer, the position of a sheet in the width direction may shift during conveyance of the sheet. On the other hand, there is known an image forming apparatus that corrects the position of the sheet in the width direction using a pair of conveying members provided so as to be movable along the width direction. For example, in the image forming apparatus of this type, the position of the sheet in the width direction is corrected based on the amount of deviation between the position in the width direction of the sheet being conveyed detected by a sensor and a reference position based on a sheet size associated with a sheet feed source of the sheet.

SUMMARY

A sheet conveying device according to an aspect of the present disclosure includes a pair of conveying members, a sensor, a movement control portion, a detection processing portion, and a switching processing portion. The pair of conveying members is provided so as to be movable along a width direction orthogonal to a conveying direction of a sheet, and nips and conveys the sheet. The sensor detects a position in the width direction of the sheet conveyed by the pair of conveying members. The movement control portion controls the movement along the width direction of the pair of conveying members which is nipping the sheet, based on the amount of shift between the detection position detected by the sensor and a reference position based on a sheet size associated with a sheet feed source of the sheet. The detection processing portion detects a sheet size of the sheet. The switching processing portion switches between permitting and not permitting the movement of the pair of conveying members based on the sheet size associated with the sheet feed source of the sheet and the sheet size of the sheet detected by the detection processing portion.

An image forming apparatus according to another aspect of the present disclosure includes the sheet conveying device and an image forming portion. The image forming portion forms an image on the sheet conveyed by the sheet conveying device.

An operation control method according to another aspect of the present disclosure is executed by a sheet conveying device including a pair of conveying members provided so as to be movable along a width direction orthogonal to a conveying direction of a sheet and configured to nip and convey the sheet; a sensor configured to detect a position in the width direction of the sheet conveyed by the pair of conveying members; and a movement control portion configured to control movement along the width direction of the pair of conveying members which is nipping the sheet, based on an amount of shift between a detection position detected by the sensor and a reference position based on a sheet size associated with a sheet feed source of the sheet, and includes a detection step and a switching step. In the detection step, a sheet size of the sheet is detected. In the switching step, whether or not to permit the movement of the pair of conveying members is switched based on the sheet size associated with the sheet feed source of the sheet and the sheet size of the sheet detected by the detection step.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the accompanying drawings. It is noted that the following embodiment is an example of embodying the present disclosure and does not limit the technical scope of the present disclosure.

[Configuration of Image Forming Apparatus 100]

First, a configuration of an image forming apparatus 100 according to the embodiment of the present disclosure will be described with reference to FIG. 1 and FIG. 2.

It is noted that, for convenience of description, the vertical direction in an installation state (the state shown in FIG. 1) in which the image forming apparatus 100 can be used is defined as an up-down direction D1. In addition, a front-rear direction D2 is defined assuming that the surface of the image forming apparatus 100 shown in FIG. 1 on the near side in the figure is the front side (front surface). In addition, a left-right direction D3 is defined with reference to the front side of the image forming apparatus 100 in the installation state.

Figure 4:
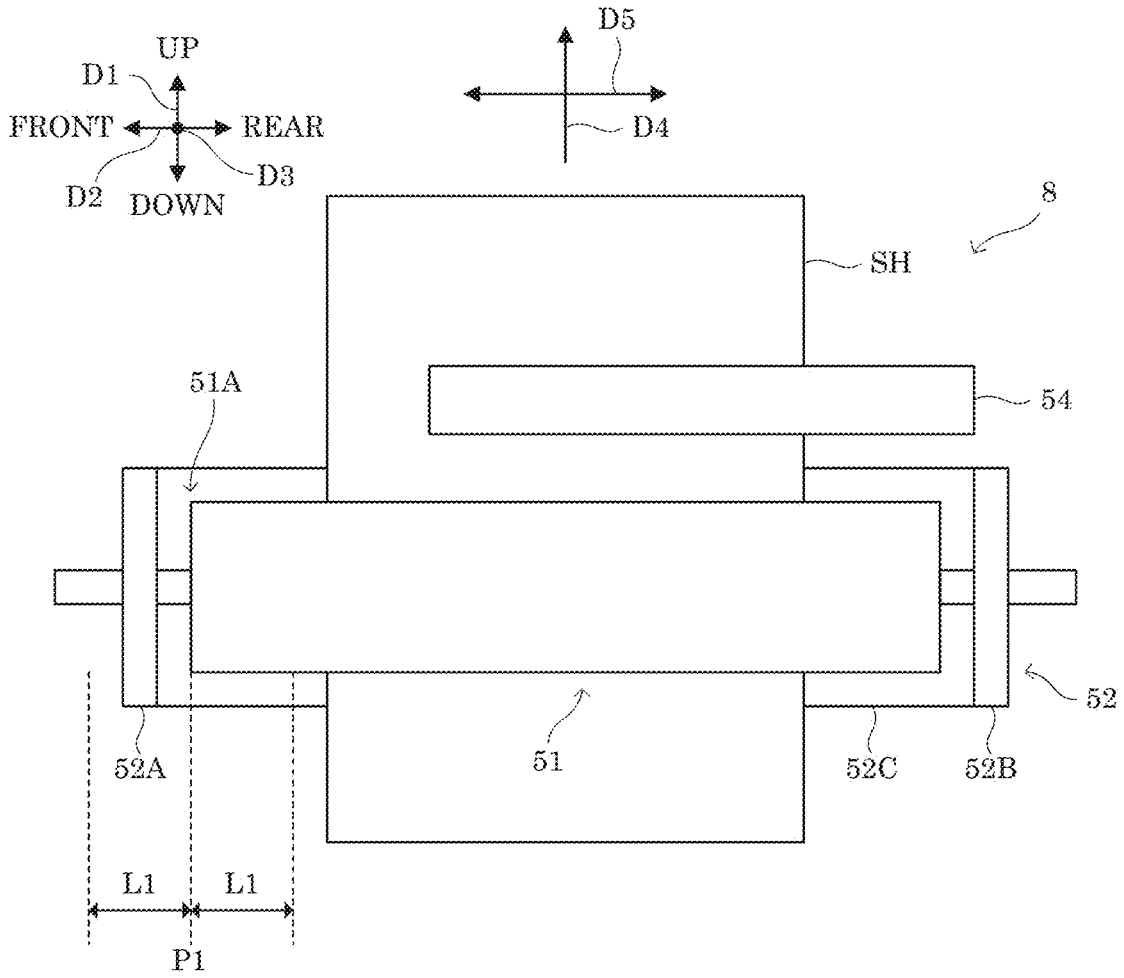
FIG. 4 is a right side view showing a configuration of a position correction unit of the image forming apparatus according to the embodiment of the present disclosure.

The image forming apparatus 100 is an image processing apparatus having a print function for forming an image based on image data on a sheet SH (see FIG. 4). Specifically, the image forming apparatus 100 is a multifunction peripheral having a plurality of functions including the print function. It is noted that the image forming apparatus of the present disclosure may be a printer, a facsimile machine, a copier, or the like which has the print function.

Figure 1:
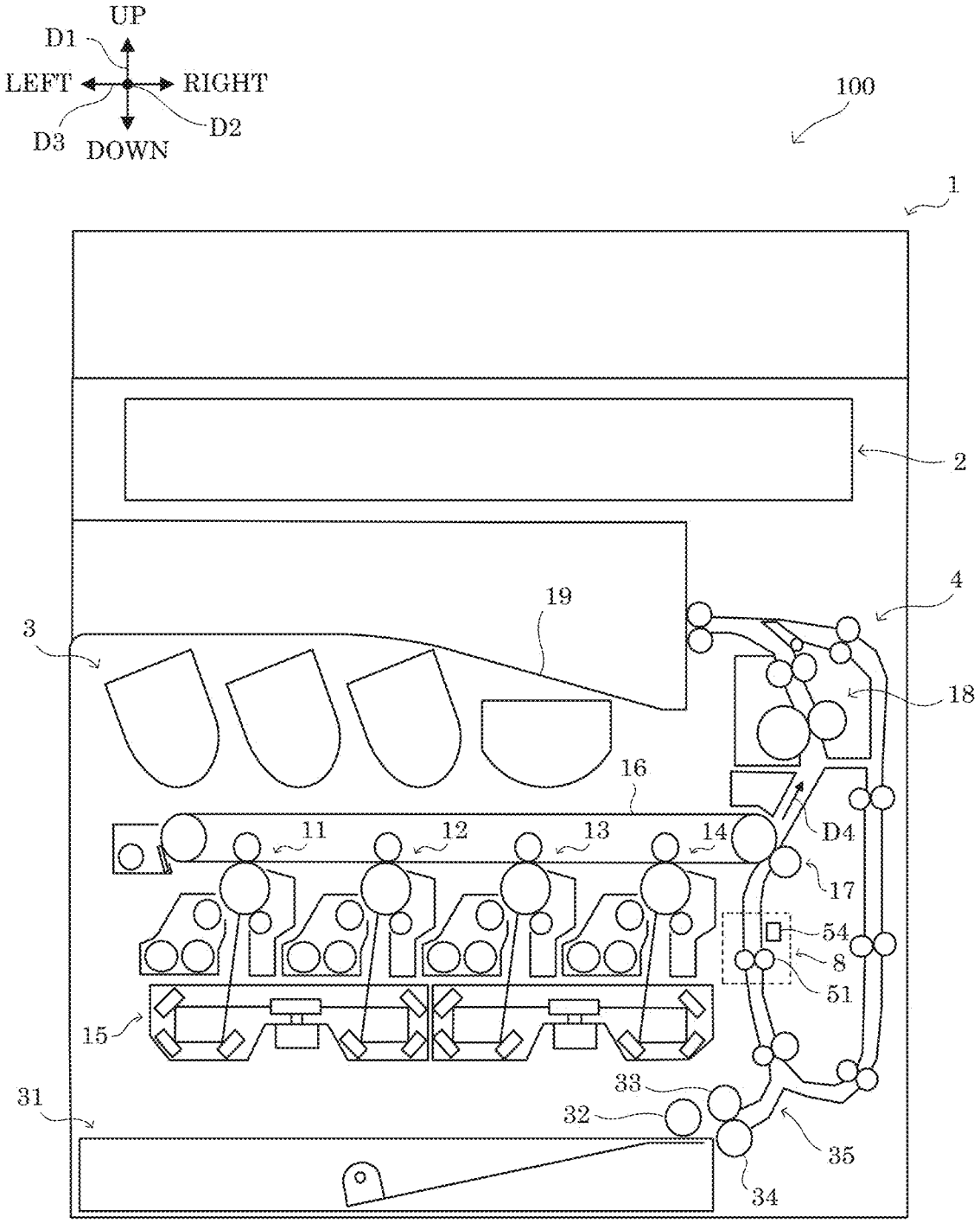
FIG. 1 is a cross-sectional view showing a configuration of an image forming apparatus according to an embodiment of the present disclosure.
Figure 2:
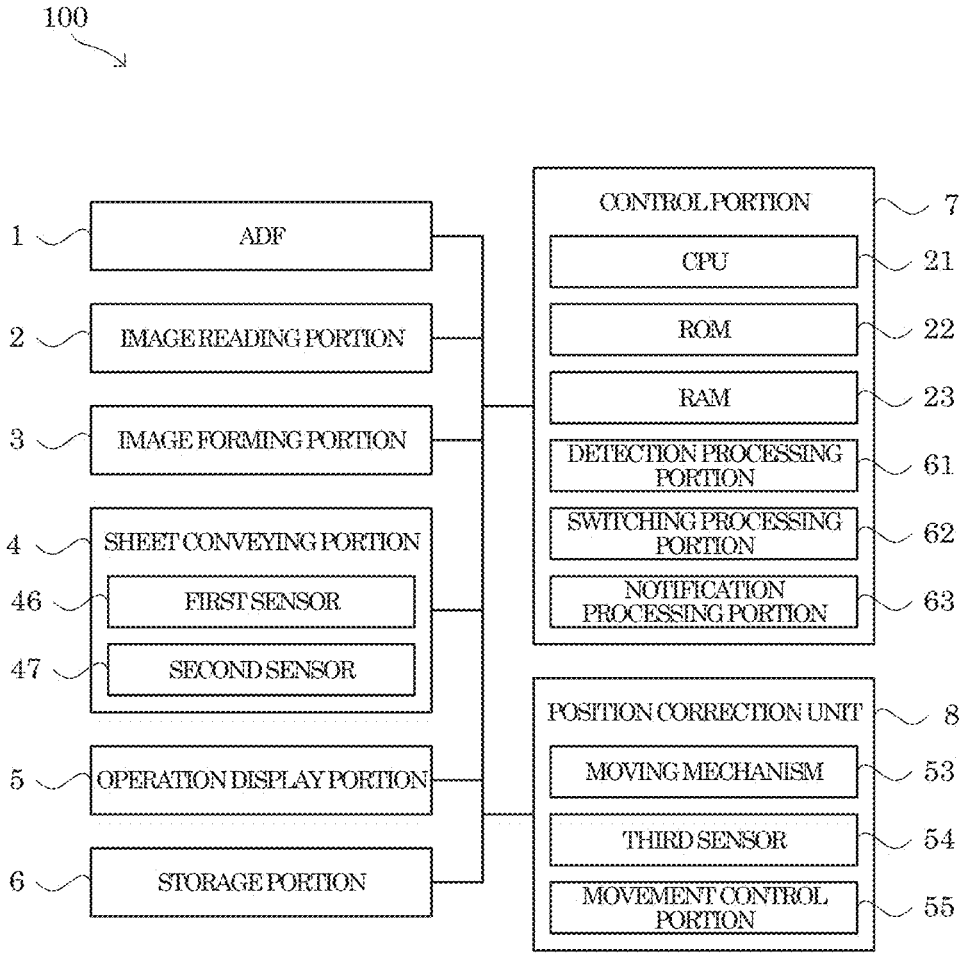
FIG. 2 is a block diagram showing a system configuration of the image forming apparatus according to the embodiment of the present disclosure.

As shown in FIG. 1 and FIG. 2, the image forming apparatus 100 includes an auto document feeder (ADF) 1, an image reading portion 2, an image forming portion 3, a sheet conveying portion 4, an operation display portion 5, a storage portion 6, and a control portion 7.

The ADF 1 conveys a document sheet whose image is read by the image reading portion 2. The ADF 1 includes a document sheet loading portion, a plurality of conveying rollers, a document sheet holder, and a sheet discharge portion.

The image reading portion 2 implements a scan function for reading an image from a document sheet. The image reading portion 2 includes a document sheet table, a light source, a plurality of mirrors, an optical lens, and a charge coupled device (CCD).

The image forming portion 3 implements the print function. Specifically, the image forming portion 3 forms a color or monochrome image on a sheet SH conveyed by the sheet conveying portion 4 in accordance with an electrophotographic method. It is noted that the image forming portion 3 may form an image on a sheet SH conveyed by the sheet conveying portion 4 in accordance with an inkjet method.

As shown in FIG. 1, the image forming portion 3 includes a plurality of image forming units 11 to 14, a laser scanning unit 15, an intermediate transfer belt 16, a secondary transfer roller 17, a fixing device 18, and a sheet discharge tray 19. The image forming unit 11 forms a toner image on the intermediate transfer belt 16 using yellow (Y) toner. The image forming unit 12 forms a toner image on the intermediate transfer belt 16 using cyan (C) toner. The image forming unit 13 forms a toner image on the intermediate transfer belt 16 using magenta (M) toner. The image forming unit 14 forms a toner image on the intermediate transfer belt 16 using black (K) toner. The plurality of image forming units 11 to 14 each include a photoconductor drum, a charging roller, a developing device, a primary transfer roller, and a drum cleaning portion. The laser scanning unit 15 emits light based on image data toward the surface of the photoconductor drum of each of the image forming units 11 to 14. A toner image formed on the surface of the photoconductor drum of each of the image forming units 11 to 14 is transferred onto the intermediate transfer belt 16. The secondary transfer roller 17 transfers the toner image transferred onto the surface of the intermediate transfer belt 16 to a sheet SH conveyed by the sheet conveying portion 4. The fixing device 18 fixes the toner image transferred to the sheet SH by the secondary transfer roller 17 to the sheet SH. The sheet SH to which the toner image has been fixed by the fixing device 18 is discharged to the sheet discharge tray 19.

The sheet conveying portion 4 conveys the sheet SH on which an image is formed by the image forming portion 3 along a conveying direction D4 (see FIG. 1). The conveying direction D4 is a direction along a plane orthogonal to the front-rear direction D2.

The operation display portion 5 is a user interface of the image forming apparatus 100. The operation display portion 5 includes a display portion and an operation portion. The display portion displays various types of information in in response to control instructions from the control portion 7. The display portion is, for example, a liquid crystal display. The operation portion inputs various types of information to the control portion 7 in response to user operations. For example, the operation portion is a touch panel.

The storage portion 6 is a nonvolatile storage device. For example, the storage portion 6 is a flash memory. It is noted that the storage portion 6 may be a solid state drive (SSD) or a hard disk drive (HDD).

The control portion 7 performs overall control of the image forming apparatus 100. It is noted that the control portion 7 may be a control portion provided separately from a main control portion that performs overall control of the image forming apparatus 100.

As shown in FIG. 2, the control portion 7 includes a CPU 21, a ROM 22, and a RAM 23. The CPU 21 is a processor that executes various types of arithmetic processing. The ROM 22 is a nonvolatile storage device in which information such as control programs for causing the CPU 21 to execute various types of processing are stored in advance. The RAM 23 is a volatile or nonvolatile storage device used as a temporary storage memory (work area) for various types of processing executed by the CPU 21. The CPU 21 performs overall control of the image forming apparatus 100 by executing various control programs stored in the ROM 22 in advance. It is noted that the control portion 7 may be composed of an electronic circuit such as an integrated circuit (ASIC).

[Configuration of Sheet Conveying Portion 4]

Next, a configuration of the sheet conveying portion 4 will be described with reference to FIG. 1 to FIG. 3.

As shown in FIG. 1, the sheet conveying portion 4 includes a sheet feed cassette 31, a pickup roller 32, a sheet feed roller 33, a separation roller 34, and a sheet conveying path 35.

The sheet feed cassette 31 accommodates sheets SH on which images are formed by the image forming portion 3. For example, the sheet feed cassette 31 accommodates sheets SH such as paper, coated paper, postcards, envelopes, and OHP sheets.

Here, in the image forming apparatus 100, a sheet size corresponding to the sheet feed cassette 31 is set in accordance with a user operation on the operation display portion 5.

For example, the control portion 7 causes the operation display portion 5 to display a sheet size setting screen used to set a sheet size associated with the sheet feed cassette 31 in accordance with a predetermined user operation on the operation display portion 5. Then, the control portion 7 sets a sheet size corresponding to the sheet feed cassette 31 in accordance with the user operation on the sheet size setting screen.

Figure 3:
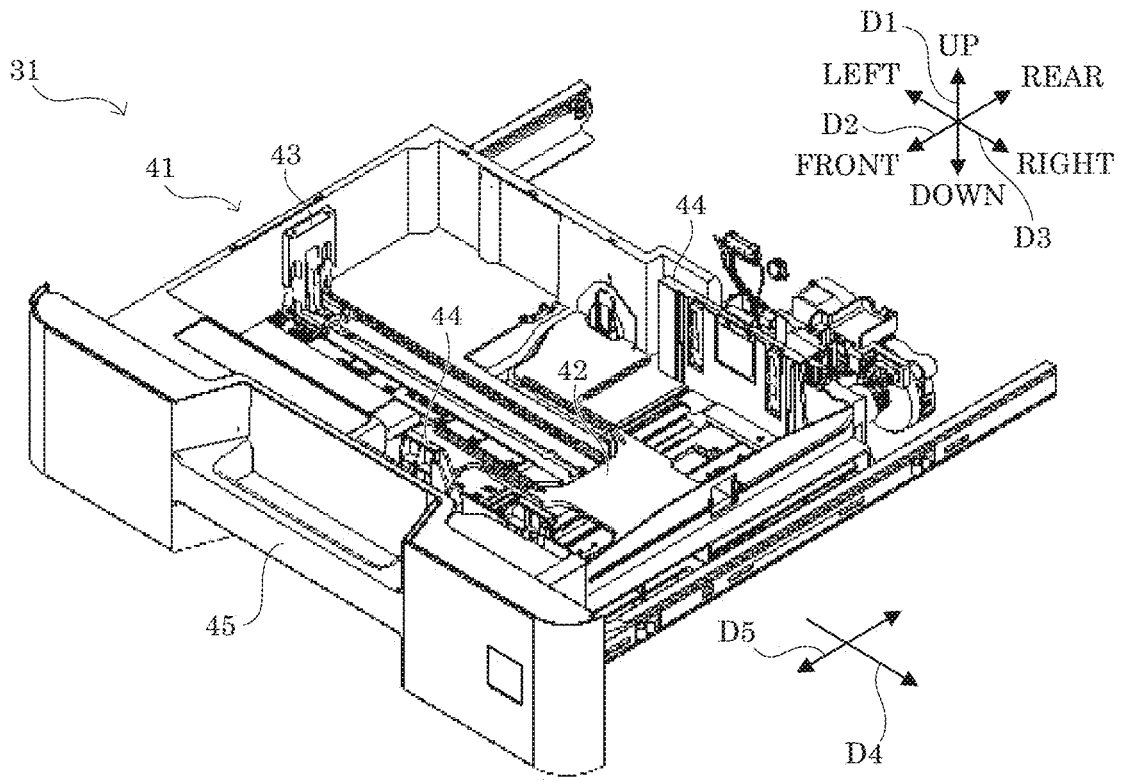
FIG. 3 is a perspective view showing a configuration of a sheet feed cassette of the image forming apparatus according to the embodiment of the present disclosure.

As shown in FIG. 3, the sheet feed cassette 31 includes a accommodating portion 41, a lift member 42, a rear end cursor 43, a pair of side cursors 44, and a grip portion 45. The sheet feed cassette 31 further includes a first sensor 46 and a second sensor 47 shown in FIG. 2.

The accommodating portion 41 defines a storage space for the sheet SH. As shown in FIG. 3, the accommodating portion 41 is formed in a box-like shape having an open top.

The lift member 42 is provided at the bottom of the accommodating portion 41 so as to be able to move up and down in the up-down direction D1. The lift member 42 lifts the stack of sheets SH stored in the sheet feed cassette 31 to a contact position where the stack of sheets SH come into contact with a pickup roller 32.

The rear end cursor 43 is provided so as to be movable in the left-right direction D3 at the bottom of the accommodating portion 41. The rear end cursor 43 is brought into contact with the rear end portion in the conveying direction D4 of the sheets SH accommodated in the accommodating portion 41 (see FIG. 1 and FIG. 3) to adjust the position of the sheets SH in the accommodating portion 41.

The pair of side cursors 44 are provided so as to be movable along the front-rear direction D2 at the bottom of the accommodating portion 41. The pair of side cursors 44 are brought into contact with both end portions in a width direction D5 of the sheets SH accommodated in the accommodating portion 41 (see FIG. 3) to adjust the position of the sheets SH in the accommodating portion 41. The width direction D5 is a direction that intersects the conveying direction D4. The position of the sheets SH in the accommodating portion 41 is adjusted by the pair of side cursors 44 so that the sheets SH stored in the sheet feed cassette 31 are conveyed along the center in the width direction D5 of the sheet conveying path 35.

The grip portion 45 is provided at the front end portion of the sheet feed cassette 31. The grip portion 45 is used to insert and remove the sheet feed cassette 31 into and out of the housing of the image forming apparatus 100.

The first sensor 46 detects the size in the conveying direction D4 of the sheets SH accommodated in the accommodating portion 41 (see FIG. 3). For example, the first sensor 46 is an electric circuit including a first variable resistor whose electric resistance changes according to the position of the rear end cursor 43 in the accommodating portion 41 and capable of outputting a first electric signal according to the electric resistance of the first variable resistor.

The second sensor 47 detects the size in the width direction D5 of the sheets SH accommodated in the accommodating portion 41 (see FIG. 3). For example, the second sensor 47 is an electric circuit including a second variable resistor whose electric resistance changes according to the distance between the pair of side cursors 44 and capable of outputting a second electric signal according to the electric resistance of the second variable resistor.

The pickup roller 32 is provided above the sheet feed cassette 31. The pickup roller 32 comes into contact with the uppermost sheet SH of the stack of sheets SH lifted to the contact position by the lift member 42, and conveys the sheet SH in the conveying direction D4 (see FIG. 1 and FIG. 3).

The sheet feed roller 33 comes into contact with the upper surface of the sheet SH to be conveyed by the pickup roller 32, and conveys the sheet SH along the sheet conveying path 35.

The separation roller 34 is provided below the sheet feed roller 33. The separation roller 34 is urged toward the sheet feed roller 33 by an urging member (not shown). Thus, a sheet feed nip portion for nipping the sheet SH is formed between the sheet feed roller 33 and the separation roller 34. When a plurality of sheets SH are conveyed to the sheet feed nip portion, the separation roller 34 separates one sheet SH of the plurality of sheets SH, which is in contact with the sheet feed roller 33, from the other sheets SH.

The sheet conveying path 35 is a path for moving sheets SH from the sheet feed cassette 31 to the sheet discharge tray 19 via the secondary transfer roller 17 and the fixing device 18. The sheet conveying path 35 is provided with the sheet feed roller 33 and the separation roller 34. In addition, the sheet conveying path 35 is provided with a plurality of conveying roller pairs spaced from each other. On the sheet conveying path 35, the sheet SH is conveyed in the conveying direction D4 (see FIG. 1) by the sheet feed roller 33 and the plurality of conveying roller pairs.

Here, in the image forming apparatus 100, when a sheet SH is conveyed, the position of the sheet SH in the width direction D5 (see FIG. 3) may shift. To deal with this, the image forming apparatus 100 is provided with a position correction unit 8 shown in FIG. 1, FIG. 2, and FIG. 4.

[Configuration of Position Correction Unit 8]

Next, a configuration of the position correction unit 8 will be described with reference to FIG. 1, FIG. 2, and FIG. 4.

The position correction unit 8 corrects the position in the width direction D5 of the sheet SH being conveyed.

As shown in FIG. 1, the position correction unit 8 is provided upstream of the secondary transfer roller 17 in the conveying direction D4 and downstream of the sheet feed roller 33 in the conveying direction D4 on the sheet conveying path 35.

As shown in FIG. 1, FIG. 2, and FIG. 4, the position correction unit 8 includes a pair of correction rollers 51, a support portion 52, a moving mechanism 53, a third sensor 54, and a movement control portion 55.

The pair of correction rollers 51 are provided so as to be movable along the width direction D5 (see FIG. 4) which is orthogonal to the conveying direction D4 (see FIG. 4) of the sheet SH, and nip and convey the sheet SH. The pair of correction rollers 51 is an example of the pair of conveying members of the present disclosure.

Specifically, the pair of correction rollers 51 is composed of a drive roller that rotates under driving force supplied from a motor (not shown) and a driven roller provided to face the drive roller. The driven roller is urged toward the drive roller by an urging member (not shown). Thus, a conveying nip portion that nips the sheet SH is formed between the drive roller and the driven roller. The pair of correction rollers 51 conveys the sheet SH in the conveying direction D4.

The support portion 52 rotatably supports the pair of correction rollers 51.

As shown in FIG. 4, the support portion 52 includes a first bearing portion 52A, a second bearing portion 52B, and an extending portion 52C. The first bearing portion 52A rotatably supports a front rotation shaft of the drive roller and a front rotation shaft of the driven roller. The second bearing portion 52B rotatably supports a rear rotation shaft of the drive roller and a rear rotation shaft of the driven roller. The extending portion 52C is elongated in the width direction D5 and supports the first bearing portion 52A and the second bearing portion 52B.

The support portion 52 is supported by the housing of the image forming apparatus 100 so as to be movable along the width direction D5 (see FIG. 4). In addition, the pair of correction rollers 51 are provided so as to be movable together with the support portion 52. Thus, when the support portion 52 is moved along the width direction D5, the pair of correction rollers 51 supported by the support portion 52 are also moved along the width direction D5.

For example, the pair of correction rollers 51 are provided such that front end portions 51A (see FIG. 4) of the pair of correction rollers 51 are movable from a home position P1 (see FIG. 4) to both sides in the width direction D5 by a distance L1 (see FIG. 4).

The moving mechanism 53 moves the pair of correction rollers 51 along the width direction D5. Specifically, the moving mechanism 53 includes a motor for generating driving force for moving the pair of correction rollers 51 and the support portion 52, and a power transmission mechanism for transmitting the driving force generated by the motor to the support portion 52. The support portion 52 is moved along the width direction D5 by the driving force transmitted from the moving mechanism 53.

The third sensor 54 detects the position in the width direction D5 of the sheet SH conveyed by the pair of correction rollers 51. The third sensor 54 is an example of the sensor of the present disclosure.

As shown in FIG. 4, the third sensor 54 is provided downstream of the pair of correction rollers 51 in the conveying direction D4 on the sheet conveying path 35. It is noted that the third sensor 54 may be provided upstream of the pair of correction rollers 51 in the conveying direction D4 on the sheet conveying path 35.

For example, the third sensor 54 is a contact image sensor (CIS) elongated in the width direction D5. The third sensor 54 is provided so as to face one end portion in the width direction D5 (the end portion on the rear side of the front-rear direction D2) of the sheet SH conveyed along the sheet conveying path 35. Specifically, the third sensor 54 is provided so as to face a an area on one side of the width direction D5 (an area on the rear side of the front-rear direction D2) with respect to the central portion in the width direction D5 of the sheet conveying path 35. When the sheet SH passes through a position facing the third sensor 54 on the sheet conveying path 35, the third sensor 54 images one end portion in the width direction D5 (the end portion on the rear side of the front-rear direction D2) of the sheet SH and outputs image data indicating the position of the end portion. The image data output from the third sensor 54 is input to the movement control portion 55. It is noted that the third sensor 54 may be a transmissive-type or reflective-type optical sensor provided side by side along the width direction D5.

The movement control portion 55 controls the movement along the width direction D5 of the pair of correction rollers 51 which is nipping the sheet SH, based on the amount of shift between a detection position detected by the third sensor 54 and a reference position based on the sheet size associated with the sheet feed source of the sheet SH (sheet feed cassette 31).

For example, the movement control portion 55 is constituted by an electronic circuit such as an integrated circuit (ASIC).

Here, the reference position is a position of one end portion in the width direction D5 (the end portion on the rear side of the front-rear direction D2) of the sheet SH when the sheet SH of the sheet size associated with the sheet feed cassette 31 passes through the position facing the third sensor 54 on the sheet conveying path 35 without shifting in the width direction D5. In the image forming apparatus 100, the reference position corresponding to the sheet size is predetermined for each sheet size of the sheets SH that can be accommodated in the sheet feed cassette 31. For example, the movement control portion 55 recognizes the reference position based on a notification from the control portion 7.

For example, the amount of shift is a positive value when the position of one end portion in the width direction D5 (the end portion on the rear side of the front-rear direction D2) of the sheet SH identified based on the image data output from the third sensor 54 is on the rear side of the front-rear direction D2 with respect to the reference position. In addition, the amount of shift is a minus value when the position of one end portion in the width direction D5 (the end portion on the rear side of the front-rear direction D2) of the sheet SH identified based on the image data output from the third sensor 54 is on the front side of the front-rear direction D2 with respect to the reference position.

When the amount of shift is a positive value, the movement control portion 55 controls the moving mechanism 53 to move the pair of correction rollers 51 which is nipping the sheet SH toward the front side of the front-rear direction D2 by the same amount as the amount of shift. In addition, when the amount of shift is a minus value, the movement control portion 55 controls the moving mechanism 53 to move the pair of correction rollers 51 which is nipping the sheet SH toward the rear side of the front-rear direction D2 by the same amount as the amount of shift. That is, the movement control portion 55 moves the pair of correction rollers 51 which is nipping the sheet SH such that one end portion in the width direction D5 (the end portion on the rear side of the front-rear direction D2) of the sheet SH is disposed at the reference position.

By the way, in the image forming apparatus 100, the sheet size associated with the sheet feed source (the sheet feed cassette 31) of the sheet SH may not match the sheet size of the sheet SH accommodated in the sheet feed source. In the conventional image forming apparatus, if the position in the width direction D5 of the sheet SH is corrected when the sheet size associated with the sheet feed source of the sheet SH does not match the sheet size of the sheet SH accommodated in the sheet feed source, the pair of correction rollers 51 may be moved beyond its movable range, causing problems such as the pair of correction rollers 51 being unmovable.

In contrast, the image forming apparatus 100 according to the embodiment of the present disclosure can suppress the occurrence of problems related to the pair of correction rollers 51, as will be described below.

[Configuration of Control Portion 7]

Next, the configuration of the control portion 7 will be described in more detail below with reference to FIG. 2.

As shown in FIG. 2, the control portion 7 includes a detection processing portion 61, a switching processing portion 62, and a notification processing portion 63. The device including the sheet conveying portion 4, the control portion 7, and the position correction unit 8 is an example of the sheet conveying device of the present disclosure. It is noted that the present disclosure may be applied to the ADF 1.

Specifically, the ROM 22 of the control portion 7 stores in advance operation control programs for causing the CPU 21 of the control portion 7 to function as the respective portions described above. By executing the operation control programs stored in the ROM 22, the CPU 21 of the control portion 7 functions as the respective portions described above. It is noted that some or all of the processing portions included in the control portion 7 may be constituted by electronic circuits. In addition, the operation control programs may be programs for causing a plurality of processors to function as the processing portions included in the control portion 7. It is noted that the control portion 7 may include the movement control portion 55.

The detection processing portion 61 detects the sheet size of the sheet SH.

For example, the detection processing portion 61 detects the sheet size of the sheet SH accommodated in the sheet feed cassette 31 using the first sensor 46 and the second sensor 47. Specifically, the detection processing portion 61 identifies the sheet size of the sheet SH accommodated in the sheet feed cassette 31, based on the size in the conveying direction D4 of the sheet SH detected by the first sensor 46 and the size in the width direction D5 of the sheet SH detected by the second sensor 47.

It is noted that the detection processing portion 61 may detect the sheet size of the sheet SH accommodated in the sheet feed cassette 31 using a sheet sensor (not shown) for detecting the sheet SH upstream of the position correction unit 8 in the conveying direction D4 on the sheet conveying path 35. Specifically, the detection processing portion 61 may calculate the size in the conveying direction D4 of the sheet SH based on the detection time of the sheet SH by the sheet sensor and the conveyance speed of the sheet SH by the sheet conveying portion 4, and identify the sheet size of the sheet SH based on the calculation result.

The switching processing portion 62 switches between permitting and not permitting the movement of the pair of correction rollers 51 based on the sheet size associated with the sheet feed source of the sheet SH and the sheet size of the sheet SH detected by the detection processing portion 61.

For example, the switching processing portion 62 permits the movement of the pair of correction rollers 51 when the sheet size associated with the sheet feed source of the sheet SH is included in a sheet size group corresponding to the sheet size of the sheet SH detected by the detection processing portion 61, and does not permit the movement of the pair of correction rollers 51 when the sheet size associated with the sheet feed source of the sheet SH is not included in the sheet size group.

Here, the sheet size group corresponding to the sheet size detected by the detection processing portion 61 includes the detected sheet size. In addition, the sheet size group corresponding to the sheet size detected by the detection processing portion 61 includes some or all of a plurality of sheet sizes whose size differences in the width direction D5 from the detected sheet size are equal to or less than twice the amount that can be corrected by the position correction unit 8 (distance L1 shown in FIG. 4). In the image forming apparatus 100, for each sheet size of the sheets SH that can be accommodated in the sheet feed cassette 31, the sheet size group corresponding to the sheet size is predetermined.

For example, when the sheet size associated with the sheet feed cassette 31 is included in the sheet size group corresponding to the sheet size detected by the detection processing portion 61, the switching processing portion 62 transmits a first control signal indicating that the movement of the pair of correction rollers 51 is permitted to the movement control portion 55 and notifies the movement control portion 55 of the reference position. In addition, when the sheet size associated with the sheet feed cassette 31 is not included in the sheet size group corresponding to the sheet size detected by the detection processing portion 61, the switching processing portion 62 transmits a second control signal indicating that the movement of the pair of correction rollers 51 is not permitted to the movement control portion 55. It is noted that the switching processing portion 62 may stop the power supply to the moving mechanism 53, the third sensor 54, and the movement control portion 55 instead of transmitting the second control signal.

It is noted that the switching processing portion 62 may permit the movement of the pair of correction rollers 51 when the sheet size associated with the sheet feed source of the sheet SH and the sheet size of the sheet SH detected by the detection processing portion 61 match each other, and does not permit the movement of the pair of correction rollers 51 when the sheet sizes do not match each other.

The notification processing portion 63 notifies when the movement of the pair of correction rollers 51 is not permitted by the switching processing portion 62.

For example, the notification processing portion 63 causes the operation display portion 5 to display a message indicating that the position correction of the sheet SH is not performed because the sheet size associated with the sheet feed cassette 31 does not match the sheet size of the sheet SH accommodated in the sheet feed cassette 31. It is noted that the notification processing portion 63 may output voice data including the message.

[Operation Control Processing]

Figure 5:
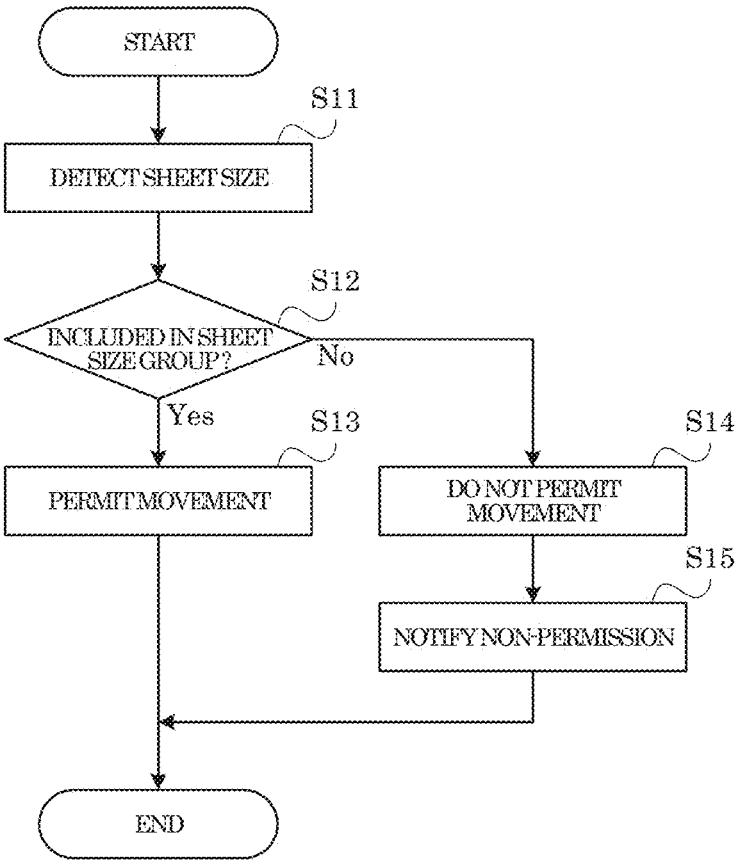
FIG. 5 is a flowchart showing an example of operation control processing executed in the image forming apparatus according to the embodiment of the present disclosure.

Next, the operation control method of the present disclosure will be described below with reference to FIG. 5, along with an example of the procedure of the operation control processing executed by the control portion 7 in the image forming apparatus 100. It is noted that, when image formation processing for forming an image on the sheet SH is executed, the operation control processing is executed prior to the image formation processing.

<Step S11>

First, in step S11, the control portion 7 detects the sheet size of the sheet SH. Here, the process of step S11 is an example of the detection step of the present disclosure, and is executed by the detection processing portion 61 of the control portion 7.

Specifically, the control portion 7 identifies the sheet size of the sheet SH accommodated in the sheet feed cassette 31 based on the size in the conveying direction D4 of the sheet SH detected by the first sensor 46 and the size in the width direction D5 of the sheet SH detected by the second sensor 47.

<Step S12>

In step S12, the control portion 7 determines whether or not the sheet size associated with the sheet feed cassette 31 is included in the sheet size group corresponding to the sheet size detected by the process of step S11.

Here, when the control portion 7 determines that the sheet size associated with the sheet feed cassette 31 is included in the sheet size group corresponding to the processing result of step S11 (Yes in S12), the processing is shifted to step S13. In addition, when the sheet size associated with the sheet feed cassette 31 is not included in the sheet size group corresponding to the processing result of step S11 (No in S12), the control portion 7 shifts the processing to step S14.

<Step S13>

In step S13, the control portion 7 permits the movement of the pair of correction rollers 51.

Specifically, the control portion 7 transmits the first control signal to the movement control portion 55, and notifies the movement control portion 55 of the reference position. Thus, the movement control portion 55 can correct the position of the sheet SH during the execution of the image formation processing.

<Step S14>

In step S14, the control portion 7 does not permit the movement of the pair of correction rollers 51. Here, the processes of step S12, step S13, and step S14 are an example of the switching step of the present disclosure, and are executed by the switching processing portion 62 of the control portion 7.

Specifically, the control portion 7 transmits the second control signal to the movement control portion 55. Thus, the position correction of the sheet SH by the movement control portion 55 during the execution of the image formation processing is restricted.

<Step S15>

In step S15, the control portion 7 notifies that the movement of the pair of correction rollers 51 is not permitted. Here, the process of step S15 is executed by the notification processing portion 63 of the control portion 7.

Specifically, the control portion 7 causes the operation display portion 5 to display the message.

As described above, in the image forming apparatus 100, whether or not to permit the movement of the pair of correction rollers 51 is switched based on the sheet size associated with the sheet feed cassette 31 and the sheet size of the sheet SH detected by the detection processing portion 61. Thus, the movement of the pair of correction rollers 51 is restricted when the sheet size associated with the sheet feed cassette 31 does not match the sheet size of the sheet SH detected by the detection processing portion 61. Therefore, it is possible to suppress the occurrence of problems such as the pair of correction rollers 51 being moved beyond its movable range, causing the pair of correction rollers 51 to be unmovable.

In addition, in the image forming apparatus 100, even when the sheet size associated with the sheet feed cassette 31 does not match the sheet size of the sheet SH detected by the detection processing portion 61, if the sheet size associated with the sheet feed cassette 31 is included in the sheet size group corresponding to the result of detection by the detection processing portion 61, the movement of the pair of correction rollers 51 is permitted. Thus, the position correction of the sheet SH can be prevented from being restricted even when the difference between the sheet size associated with the sheet feed cassette 31 and the sheet size of the sheet SH detected by the detection processing portion 61 is small and the possibility that the pair of correction rollers 51 is moved beyond its movable range is low.

APPENDIXES TO DISCLOSURE

The following are appendixes to the overview of the disclosure extracted from the above embodiment. It is noted that the structures and processing functions to be described in the following appendixes can be selected and combined arbitrarily.

APPENDIX 1

A sheet conveying device comprising: a pair of conveying members provided so as to be movable along a width direction orthogonal to a conveying direction of a sheet and configured to nip and convey the sheet; a sensor configured to detect a position in the width direction of the sheet conveyed by the pair of conveying members; a movement control portion configured to control movement along the width direction of the pair of conveying members which is nipping the sheet, based on an amount of shift between a detection position detected by the sensor and a reference position based on a sheet size associated with a sheet feed source of the sheet; a detection processing portion configured to detect a sheet size of the sheet; and a switching processing portion configured to switch between permitting and not permitting the movement of the pair of conveying members, based on the sheet size associated with the sheet feed source of the sheet and the sheet size of the sheet detected by the detection processing portion.

APPENDIX 2

The sheet conveying device according to Appendix 1, wherein the switching processing portion permits the movement of the pair of conveying members when the sheet size associated with the sheet feed source of the sheet matches the sheet size of the sheet detected by the detection processing portion and does not permit the movement of the pair of conveying members when the sheet size associated with the sheet feed source of the sheet does not match the sheet size of the sheet detected by the detection processing portion.

APPENDIX 3

The sheet conveying device according to Appendix 1, wherein the switching processing portion permits the movement of the pair of conveying members when the sheet size associated with the sheet feed source of the sheet is included in a sheet size group corresponding to the sheet size of the sheet detected by the detection processing portion, and does not permit the movement of the pair of conveying members when the sheet size associated with the sheet feed source of the sheet is not included in the sheet size group.

APPENDIX 4

The sheet conveying device according to any one of Appendixes 1 to 3, further comprising: a notification processing portion configured to notify when the movement of the pair of conveying members is not permitted by the switching processing portion.

APPENDIX 5

An image forming apparatus comprising: the sheet conveying device according to any one of Appendixes 1 to 4; and an image forming portion configured to form an image on the sheet conveyed by the sheet conveying device.

APPENDIX 6

An operation control method executed by a sheet conveying device comprising a pair of conveying members provided so as to be movable along a width direction orthogonal to a conveying direction of a sheet and configured to nip and convey the sheet; a sensor configured to detect a position in the width direction of the sheet conveyed by the pair of conveying members; and a movement control portion configured to control movement along the width direction of the pair of conveying members which is nipping the sheet, based on an amount of shift between a detection position detected by the sensor and a reference position based on a sheet size associated with a sheet feed source of the sheet, the operation control method comprising: a detection step of detecting a sheet size of the sheet; and a switching step of switching between permitting and not permitting the movement of the pair of conveying members, based on the sheet size associated with the sheet feed source of the sheet and the sheet size of the sheet detected by the detection step.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

an operation display portion;

a sheet feed cassette configured to accommodate a sheet;

a pair of conveying members provided to be movable along a width direction orthogonal to a conveying direction of the sheet and configured to nip and convey the sheet from the sheet feed cassette;

a sensor configured to detect a position in the width direction of the sheet conveyed by the pair of conveying members;

a movement control portion configured to control movement along the width direction of the pair of conveying members which is nipping the sheet, based on an amount of shift between a detection position detected by the sensor and a reference position based on a sheet size corresponding to the sheet feed cassette set in accordance with a user operation on the operation display portion;

a detection processing portion configured to detect a sheet size of the sheet accommodated in the sheet feed cassette; and a switching processing portion configured to determine, before the conveyance of the sheet from the sheet feed cassette starts, whether the sheet size corresponding to the sheet feed cassette set in accordance with the user operation on the operation display portion matches the sheet size of the sheet detected by the detection processing portion, and switch between permitting and not permitting the movement of the pair of conveying members by the movement control portion, based on a result of the determination.

2. The sheet conveying device according to claim 1, wherein the switching processing portion permits the movement of the pair of conveying members by the movement control portion when the sheet size corresponding to the sheet feed cassette set in accordance with the user operation on the operation display portion matches the sheet size of the sheet detected by the detection processing portion and does not permit the movement of the pair of conveying members by the movement control portion when the sheet size corresponding to the sheet feed cassette set in accordance with the user operation on the operation display portion does not match the sheet size of the sheet detected by the detection processing portion.

3. The sheet conveying device according to claim 1, wherein the switching processing portion permits the movement of the pair of conveying members by the movement control portion when the sheet size corresponding to the sheet feed cassette set in accordance with the user operation on the operation display portion is included in a sheet size group corresponding to the sheet size of the sheet detected by the detection processing portion, and does not permit the movement of the pair of conveying members by the movement control portion when the sheet size corresponding to the sheet feed cassette set in accordance with the user operation on the operation display portion is not included in the sheet size group.

4. The sheet conveying device according to claim 1, further comprising:

a notification processing portion configured to notify when the movement of the pair of conveying members is not permitted by the switching processing portion.

5. An image forming apparatus comprising:

the sheet conveying device according to claim 1; and an image forming portion configured to form an image on the sheet conveyed by the sheet conveying device.

6. An operation control method executed by a sheet conveying device comprising: an operation display portion, a sheet feed cassette configured to accommodate a sheet; a pair of conveying members provided to be movable along a width direction orthogonal to a conveying direction of the sheet and configured to nip and convey the sheet from the sheet feed cassette; a sensor configured to detect a position in the width direction of the sheet conveyed by the pair of conveying members; and a movement control portion configured to control movement along the width direction of the pair of conveying members which is nipping the sheet, based on an amount of shift between a detection position detected by the sensor and a reference position based on a sheet size corresponding to the sheet feed cassette set in accordance with a user operation on the operation display portion, the operation control method comprising:

a detection step of detecting a sheet size of the sheet accommodated in the sheet feed cassette; and a switching step of determining, before the conveyance of the sheet from the sheet feed cassette starts, whether the sheet size corresponding to the sheet feed cassette set in accordance with the user operation on the operation display portion matches the sheet size of the sheet detected by the detection step, and switching between permitting and not permitting the movement of the pair of conveying members by the movement control portion, based on a result of the determination.

* * * * *